US006948198B1

(12) United States Patent
Eldersveld

(10) Patent No.: US 6,948,198 B1
(45) Date of Patent: Sep. 27, 2005

(54) BED WITH UNITARY HEADBOARD AND UNITARY FRAME

(75) Inventor: Steven M. Eldersveld, Grand Rapids, MI (US)

(73) Assignee: R. T. London Company, Grand Rapids, MI (US)

( * ) Notice: Subject to any disclaimer, the term of this patent is extended or adjusted under 35 U.S.C. 154(b) by 0 days.

(21) Appl. No.: 10/711,275

(22) Filed: Sep. 7, 2004

Related U.S. Application Data

(60) Provisional application No. 60/481,329, filed on Sep. 4, 2003.

(51) Int. Cl.[7] ..... A47C 19/00

(52) U.S. Cl. ..... 5/132; 5/8; 5/9.1; 5/201; 5/281; 5/285; 5/296

(58) Field of Search ..... 5/8, 9.1, 53.1, 5/132, 200.1, 201, 204, 206, 280, 285, 286, 5/296

(56) References Cited

U.S. PATENT DOCUMENTS

| | | | | | |
|---|---|---|---|---|---|
| 2,671,910 | A | * | 3/1954 | Frank | 5/280 |
| RE27,182 | E | * | 9/1971 | Fredman | 5/238 |
| 3,736,603 | A | * | 6/1973 | Rothman | 5/53.1 |
| 3,914,810 | A | * | 10/1975 | Harris | 5/286 |
| 3,961,381 | A | * | 6/1976 | Weinhart et al. | 5/296 |
| 4,169,294 | A | * | 10/1979 | Harris | 5/200.1 |
| 4,856,127 | A | * | 8/1989 | Lenger | 5/53.1 |
| 6,637,052 | B2 | * | 10/2003 | Nockles | 5/131 |

* cited by examiner

*Primary Examiner*—Michael Trettel
(74) *Attorney, Agent, or Firm*—McGarry Bair PC

(57) ABSTRACT

A unitary headboard comprises a single piece of laminated plywood that has two posts and at least one cross piece cut out of it. A bed frame comprising side rails and cross supports has each side rail formed of a single piece of material. Each side rail has a support ledge and a lip where the foundation extending between the side rails can be selected from springs or boards at the user's option.

20 Claims, 6 Drawing Sheets

BED WITH UNITARY HEADBOARD AND UNITARY FRAME

CROSS REFERENCE TO RELATED APPLICATION

This application claims the benefit of U.S. Application Ser. No. 60/481,329 filed Sep. 4, 2003.

FIELD OF THE INVENTION

The invention relates to beds and more particularly to the structure and fabrication of headboards and bed frames.

DESCRIPTION OF THE RELATED ART

Case goods sold to institutions such as schools and colleges often include beds comprising wooden headboards and metal bed frames. The term "headboards" typically includes both headboards and footboards, since they are usually identical at least in dimension. Consequently, beds can optionally be stacked atop one another to form bunk beds and save space. Also, in colleges especially, it is common to mount the headboards on extenders so that the bed will be elevated, providing space beneath the bed for desks, chairs and the like.

Wooden headboards are typically fabricated from two posts and at least one crosspiece extending between the posts. The crosspiece is joined to the posts by doweling and gluing or by mortise and tenon joints. Under normal use, this ancient construction serves adequately, but with heavy institutional use and with changes in climate (e.g., temperature and humidity), it is not uncommon for the joints to loosen. This will typically increase maintenance costs and possibly diminish the durability of the bed.

Bed frames are commonly fabricated from angle iron side rails and end rails, welded together in a square with one or more reinforcing pieces extending between the side rails. Springs or wires are strung between the rails to support a mattress. A mounting bracket adapted to hang on pins in each post of a headboard is riveted to a side rail at each corner of the bed frame. Frequently the joints between the mounting brackets and the side rails loosen under heavy use, leading to early failure of the bed frame.

This problem was solved by the development of a unitary side rail by Norse Furniture Company where the mounting brackets are integrally formed with the side rail. The unitary rail is typically formed first by stamping and then by rolling selected edges to stiffen the rail and provide mounting surfaces for springs and the like. It is known to mount plywood boards in place of the springs in the bed frame. The boards are typically bolted to the side rails. While the unitary side rail solves the problem of loosening joints found in earlier side rails, the assembly of the bed remains labor-intensive. Moreover, manufacturers have to stock two different types of bed frames, one for springs and another for boards. As well, problems with fabricated headboards remain.

SUMMARY OF THE INVENTION

These and other problems are solved by the present invention of a unitary headboard comprising two posts and at least one cross support extending between the posts. The posts and the cross support are integrally formed from a single piece of material and are capable of supporting a bed frame. Preferably, the posts and the cross support are integrally formed from a single piece of plywood.

The headboard can further have a stacking projection extending from an upper end of each post. Preferably, the stacking projection is integrally formed from the same piece of material as the posts and the cross support. In like manner, the headboard can have a stacking recess in a lower end of each post. The stacking recess is preferably complementary in shape to the stacking projection.

In one aspect, the cross support can be a stylized shape. Also, a bedpost unit can be mounted to each post. Likewise, a tab insert channel can be disposed in each post.

Another aspect of the invention is found in an improvement in a bed frame comprising side rails and cross supports. Each side rail is formed of a single piece of material and comprises an upwardly extending lip and a support ledge extending generally horizontally from the lip.

Each side rail further has a reinforcement flange. Preferably, the support ledge comprises holes adapted to receive springs. Thus, the bed frame is adapted to handle both springs and foundations such as wood. Preferably, the lip extends above the support ledge less than 50% of the height of the side rail. As well, a gusset at each end of the side rail extends above the support ledge.

In yet another aspect of the invention, an improvement is provided in a bed comprising two headboards spaced from each other and a bed frame mounted to and extending between the headboards. One of the headboards is a unitary headboard comprising two posts and at least one cross support extending between the posts. The posts and the cross support are integrally formed from a single piece of material and are capable of supporting the bed frame.

Preferably, the posts and the cross support of the unitary headboard are integrally formed from a single piece of plywood. Also, the cross support of the unitary headboard can be a stylized shape.

Further, the bed frame has side rails where each side rail has an upwardly extending lip and a support ledge extending generally horizontally from the lip. Each side rail can also have a reinforcement flange. The support ledge includes holes adapted to receive springs. Preferably, the lip extends above the support ledge less than 50% of the height of the side rail. And the side rail can have a gusset at each end of the side rail, wherein the gusset extends above the support ledge.

DETAILED DESCRIPTION

Looking now at the drawings, the invention is embodied in a bed made up of a pair of unitary or single piece headboards 10 and a unitary bed frame comprising a pair of single piece side rails 36. The single piece headboard 10 includes any structure that forms the head or foot of the bed, and which is crafted as a single unit, i.e., one without joints. The single unit can be blocked out of a larger piece of material using any number of cutting or material removal methods, including but not limited to, blanking out the material using a press or other blanking device or cutting the material using an automatic programmed machine such as a computer numerical control (CNC) machine or manual cutting. Cutting tools employed could include, but are not limited to, wire electrical discharge machining (EDM), mechanical blades, lasers, ultrasonic or water jet streams, a lathe, a mill, or other cutting devices. The single unit can also be created from a collection of smaller units forming a single mass including, but not limited to, any molding, sintering, or material deposition operation.

Preferably, a sheet of high-grade plywood of a common thickness such as three-fourth inch could serve as the single piece headboard 10 material as could any other suitable material including, but not limited to, any wood, plastic, metal, ceramic, or fiberglass.

Figure 1:
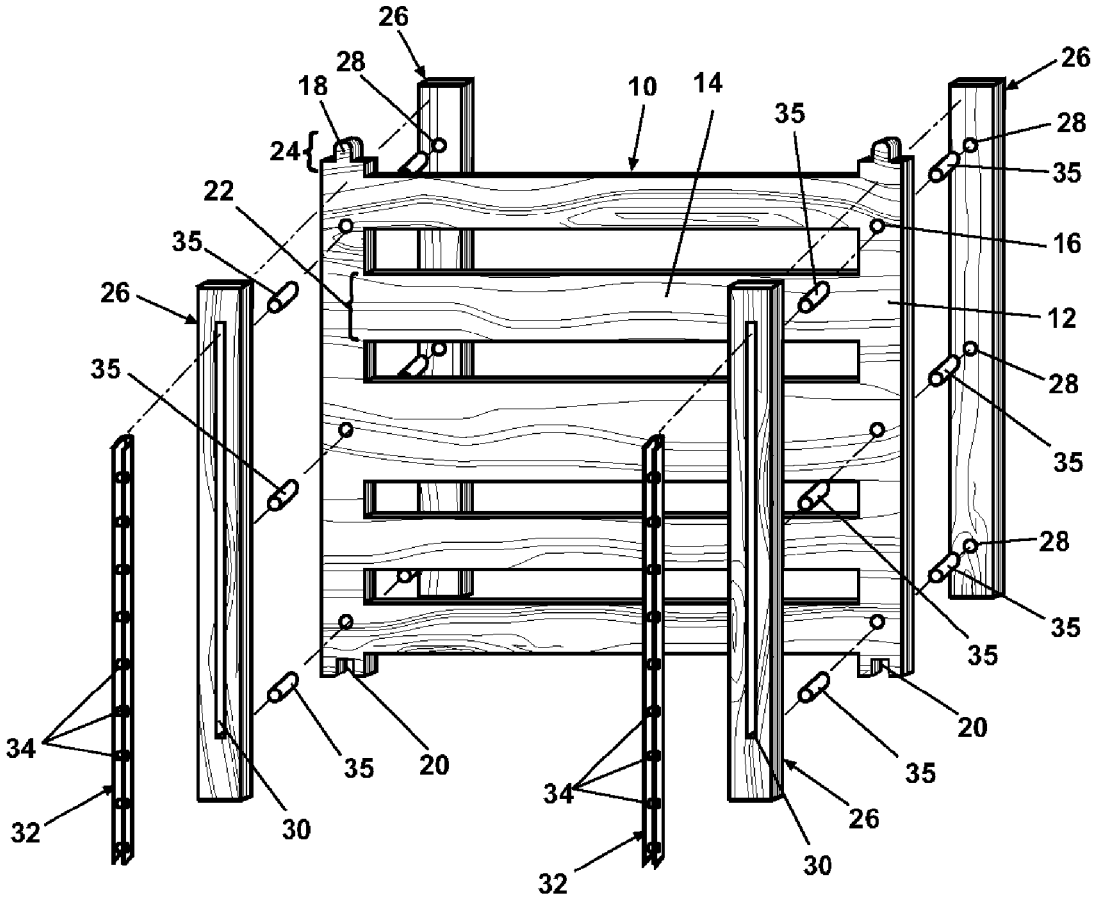
FIG. 1 is an exploded view of a headboard according to the invention.
Figure 7:
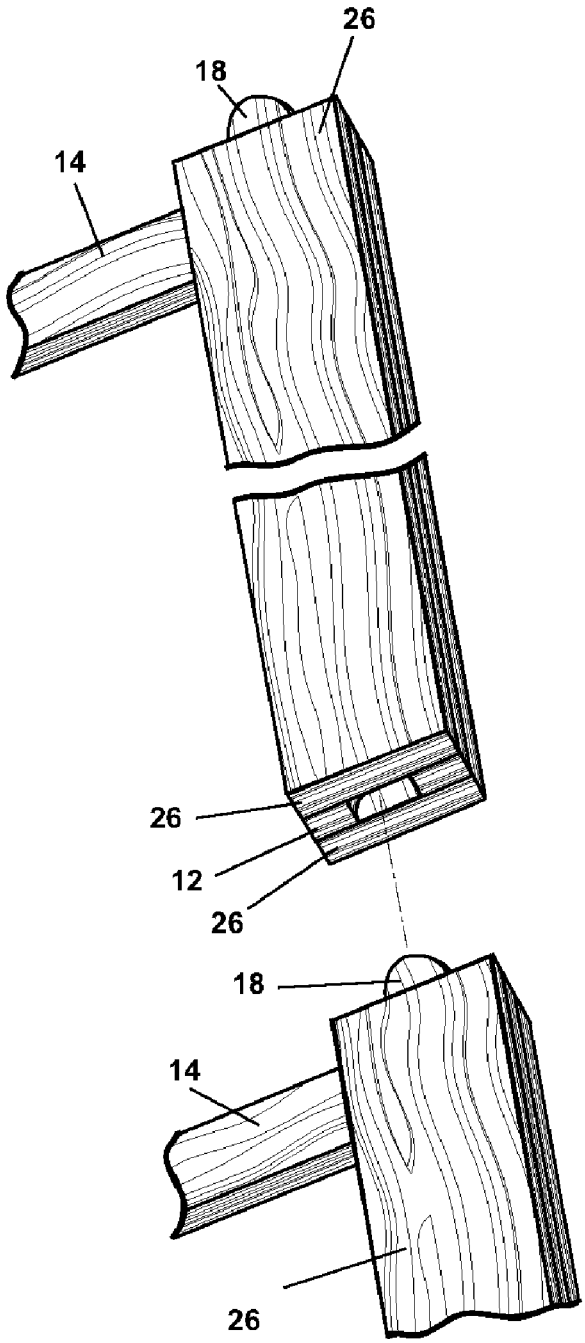
FIG. 7 is an exploded fragmentary view of two headboards according to the invention.
Figure 8:
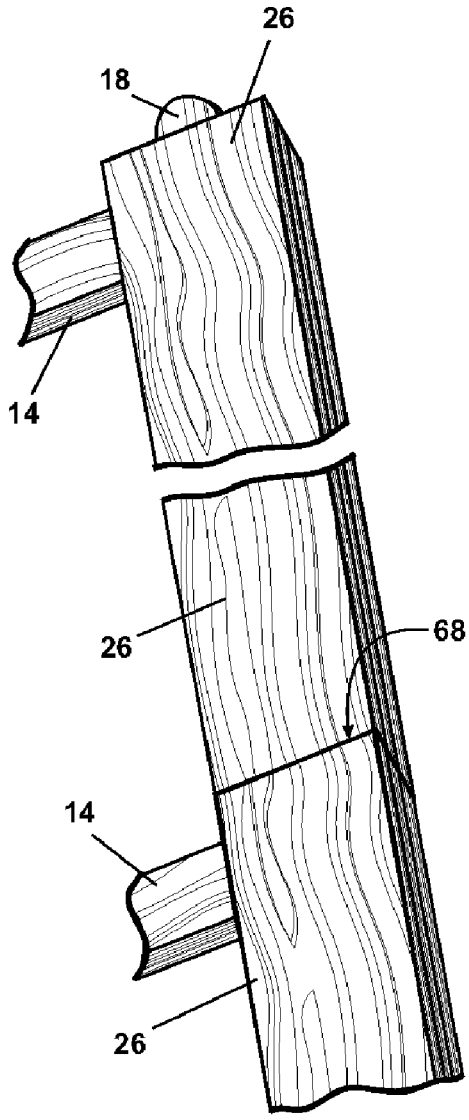
FIG. 8 is a fragmentary view of the two headboards of FIG. 7 joined together.

Referring first to FIGS. 1, 7 and 8, the headboard comprises a pair of posts 12 with at least one cross support 14 extending between them. The pair of posts 12 is integrated as a single piece of material with the cross support 14 at intersection points 22. As shown in FIG. 1, the headboard 10 can include multiple cross supports 14, in which case the space between adjacent cross supports is preferably sized to be compliant with locally applicable law and regulations.

Figure 2:
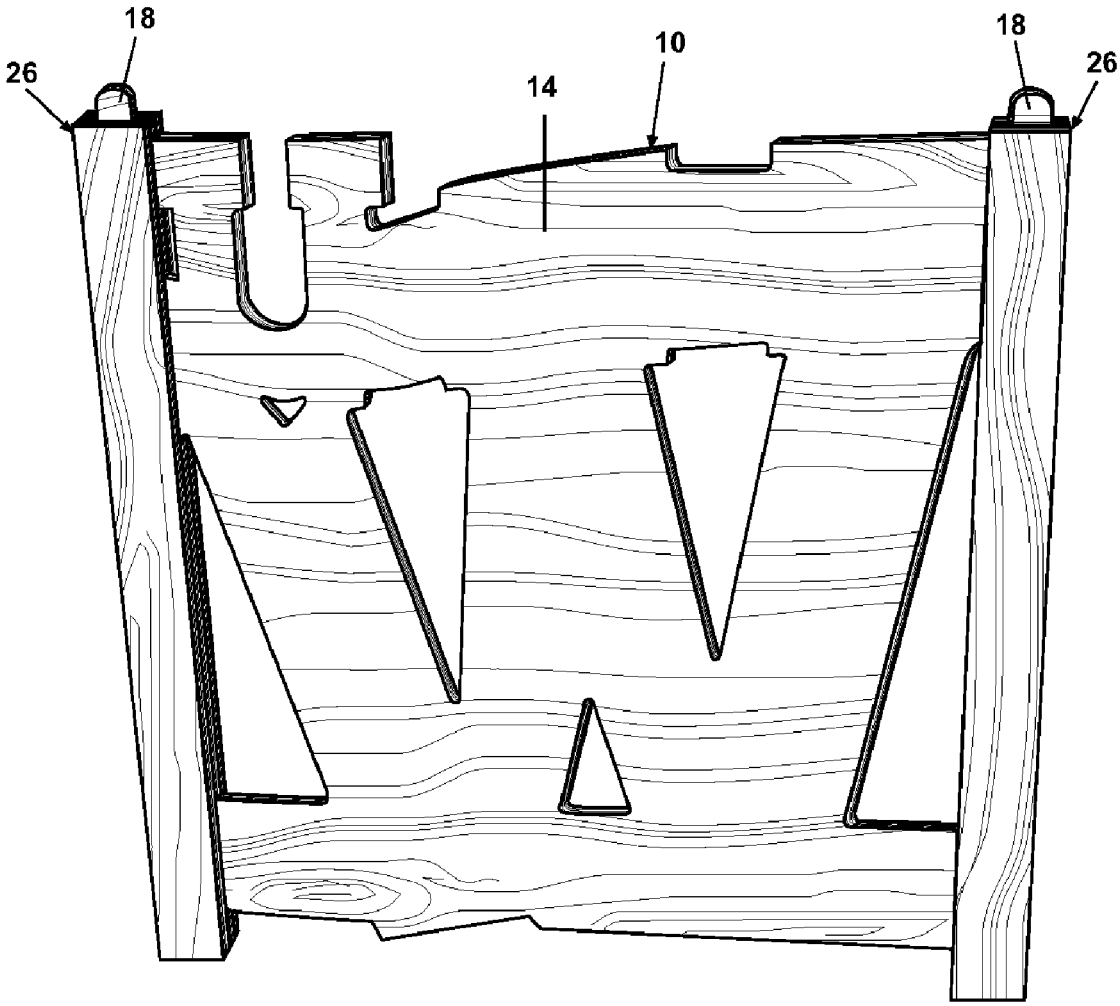
FIG. 2 is a perspective view of an alternative embodiment of a headboard according to the invention.

Each post 12 can be any shape such as columns, cylinders, oblong shapes, or any of a number of stylistic shapes so long as it provides adequate vertical support for the single piece headboard 10. Each cross-support 14 likewise can be any shape including stylistic shapes and letters so long as it provides adequate support in compression or tension between the posts 12 of headboard 10. See FIG. 2 for illustration of a stylized form of cross piece 14.

A stacking projection 18, which can be either a projection that is centered on top of each of the two posts or any number of projections located elsewhere, is preferably integrated as a single piece with post 12, with cross support 14, with both, or with any part on the headboard 10 at an intersection point 24. The stacking projection 18 can also be a dowel or pin that is secured in the post 12. A stacking recess 20 is disposed at the opposite end of each post 12, and is a recess that can be created by material being removed or omitted during fabrication. The stacking recess 20 can be either a recess centered at the bottom of the each of the posts or any number of recesses located elsewhere on the single piece headboard 10 as shown in FIG. 1.

The stacking projection 18 can be any suitable shape for which the stacking recess 20 is complementary so that the projection 18 can be received snuggly in the recess 20 to form a joint 68 illustrated in FIG. 8. Here the stacking projection 18 is a monolithic shape with dimensions nearly identical to, but slightly smaller than, stacking recess 20. Preferably, the stacking recess 20 is sized to provide a close tolerance fit with the stacking projection 18.

The joint 68 is at a location in which the stacking projection 18 of a first single piece headboard 10 comes within near proximity of the stacking recess 20 of a second single piece headboard 10, as in the case when one bed is stacked on top of another. Such a joint is particularly illustrated in FIGS. 7 and 8. The joint 68 can function to prevent any misorientation or slippage between the two single piece headboards when they are stacked or otherwise touching in a case where orientation or stability is important. The stacking projection 18 and the stacking recess 20 can also function to prevent any misorientation or slippage between the single piece headboard 10 and other furniture that contains stacking supports and stacking recesses that can interact with the stacking supports 18 or the stacking recesses 20.

One or more additional bedpost units 26 can be secured to the front, back, or both front and back of the post section 12 of the single piece headboard 10 as shown in FIG. 1 to provide additional bulk to the posts 12, to increase their supporting capacity, and to render an appearance that is more traditional. Inasmuch as a preferred material for the single piece headboard 10 is plywood, a preferred material for the additional bedpost units 26 is also plywood of the same composition as the single piece headboard. When secured to the posts 12, the additional bedpost units 26 effectively become a continuation of the plywood lamination of the posts. Each additional bedpost unit 26 can be oriented on its corresponding post 12 by using pegs 35 that can be received in corresponding orientation apertures 16 on the post 12 and bedpost orientation apertures 28 on the additional bedpost unit 26. The location of the respective apertures 16, 28 can be disposed as appropriate and convenient, depending upon a particular configuration. Once the additional bedpost unit 26 and corresponding post 12 are properly in register, the additional bedpost unit 26 can be fastened to the headboard 10 using glue, fasteners, or other methods.

The orientation aperture 16 and the bedpost unit orientation aperture 28 can be holes cut by the CNC machine in the initial cutting step, or they can be any depression or hole in which the peg 35 can interact. The peg 35 could be a cylindrical shape as shown in FIG. 1 or it could be any shape, that can fit or rest inside orientation aperture 22 and the bedpost unit orientation aperture 26 and the exact shape is understood not to be limiting on the scope of this invention. The post 12 could provide adequate support without the additional bedpost unit 26.

While the additional bedpost unit 26 can provide additional structural support for the single piece headboard 10 or the single piece head board 10 stacked with another bed unit or other furniture, its presence is understood not to be limiting on the scope of this invention.

A tab insert channel 32, with a series of tab insert locations 34, provides support for a bed frame as explained below. The tab insert channel 32 is a long, "U-shaped" channel that can be made to a length somewhat shorter than the height of the post 12 and can be comprised of steel or any other suitable material. The tab insert locations 34 can be notches stamped, pressed, or otherwise shaped into the tab insert channel 32 or, preferably, they can be pins made out of the same material as tab insert channel 32 or another suitable material, and are welded, fastened, peened or otherwise attached to the tab insert channel 32. Each tab insert location 34 could serve as a height adjustment location when attaching a bed frame to the single piece headboard 10.

Each single piece headboard 10 has a tab insert channel 32 mounted to each one of the two posts 12 or into the two of the additional post unit 26, using glue, fasteners, compression fit, or other attachment methods. The tab insert channel 32 can also be mounted at any number of other locations in the headboard 10. A recess 30 can be made in the additional bedpost unit 26 or the posts 12 so the tab insert channel 32 will be recessed into the headboard 10 or into the additional bedpost unit 26. The recess 30 can be any depression or opening made by either removing or omitting material during the initial fabrication process, or removing material after fabrication of the single piece headboard 10 or the additional bedpost unit 26.

Figure 3:
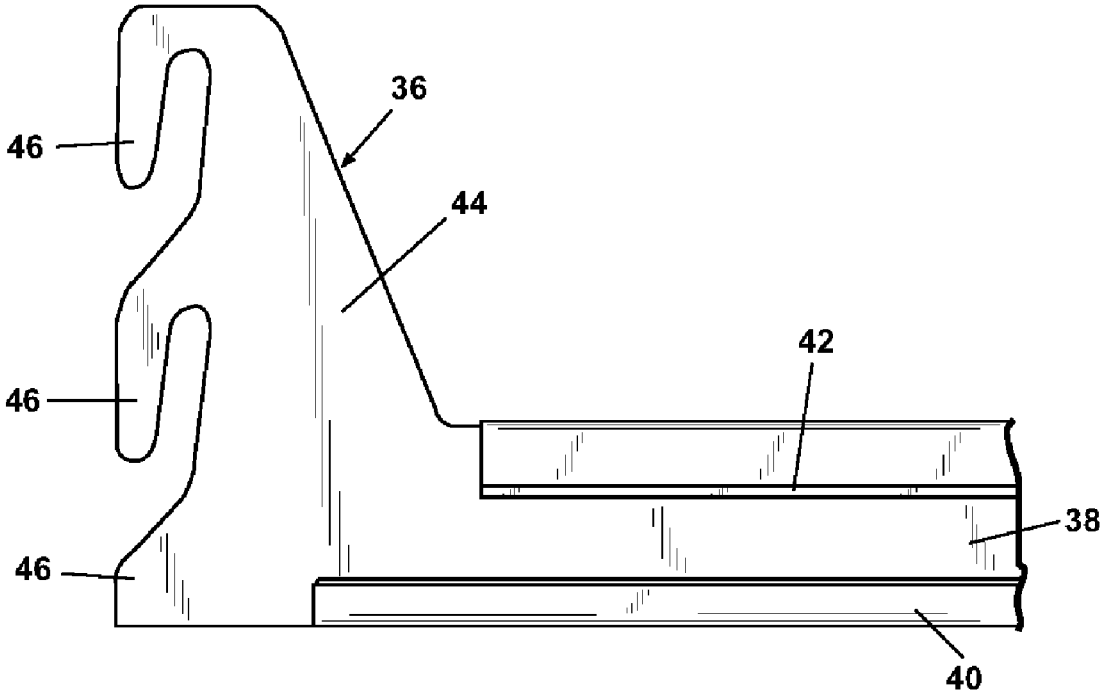
FIG. 3 is a side view of a portion of a side rail for a bed frame according to the invention.
Figure 4:
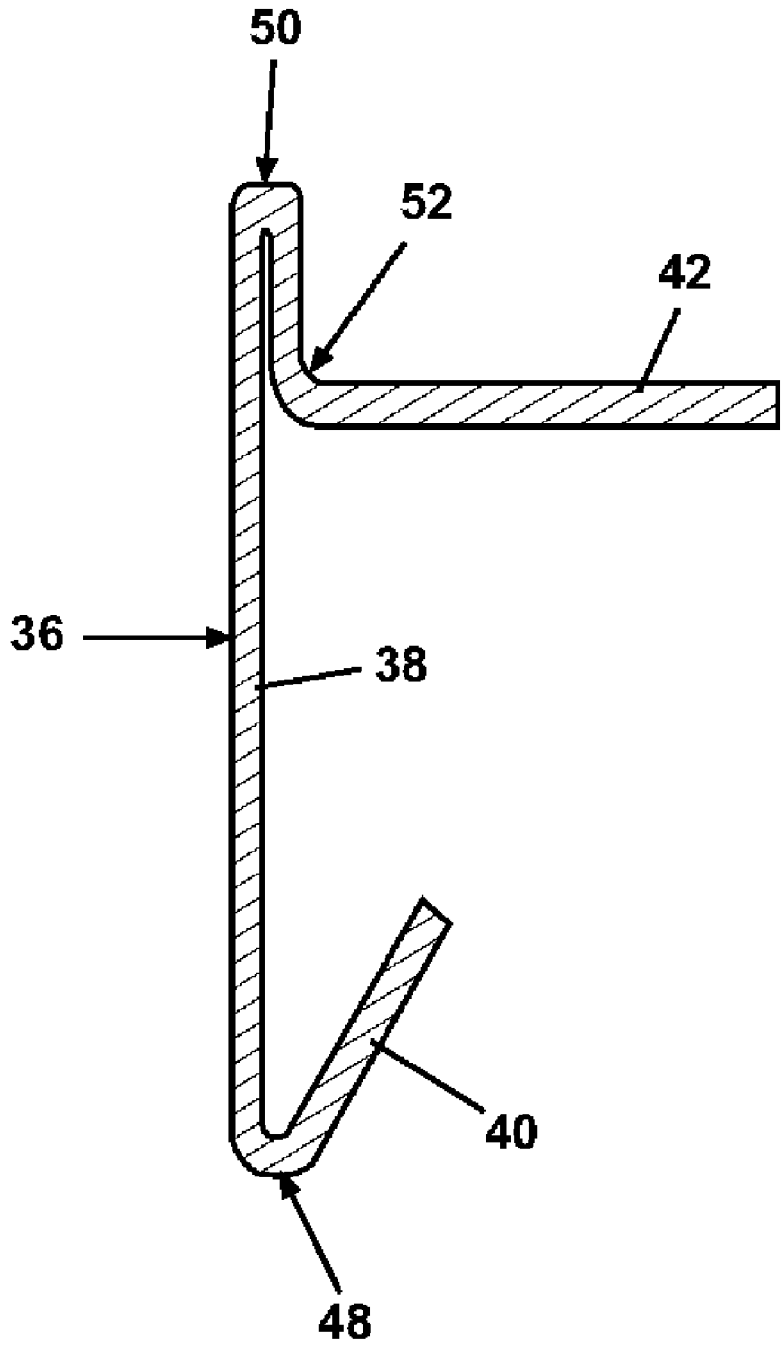
FIG. 4 is a cross sectional view of the side rail taken along lines 4—4 of FIG. 3.

FIGS. 3–6 illustrate elements of a bed frame 54 according to the invention, which can, but need not, be used with single piece headboards 10 as described above. FIG. 3 depicts a single piece side rail 36 of the bed frame 54. The single piece side rail 36 can be any structure crafted as a single unit that is positioned along either one or both sides of the bed frame 54. The single unit can be blocked out of a larger piece of material using any number of cutting or material removal methods including but not limited to blanking out the material using a press or other blanking device or cutting using an automatic programmed machine such as a computer numerical control (CNC) machine or manual cutting. Cutting tools employed can include, but are not limited to, wire electrical discharge machining (EDM), mechanical blades, lasers, ultrasonic or water jet streams, or other cutting devices. The single unit can also be created from a collection of smaller units forming a single mass including, but not limited to, any molding, sintering, or material deposition operation.

A number of different steels could serve as the material for the single piece side rail 36 as could any other suitable material including, but not limited to, any wood, plastic, metal, ceramic, or fiberglass.

The single piece side rail 36 includes a railing 38, a reinforcement flange 40, a support ledge 42, a gusset 44, and a fastening tab 46. The railing 38 is the main horizontal support and extends from the first gusset 44 to the second gusset 44 or to the end of the single piece side rail 28. The fastening tab 46 contains two or more tabs which preferably are shaped like flat "J-shaped" hooks and are used to hang the single piece side rail 28 with on the tab insert locations 34 of the tab insert channel 32, or similar structure in a headboard. The fastening tabs 46 can be located at the end of the gusset 44 or the end of the railing 38.

The support ledge 42 is integrated as a single piece of material with the railing 38 by rolling over a portion of the railing 38 at bend 50 and also rolling a bend 52 so that the support ledge 42 extends generally perpendicularly from the railing 38. Similarly, a reinforcement flange 40 is a long segment running parallel to the single piece side rail 36 and preferably integral with it. The reinforcement flange 40 provides additional strength to the single piece side rail 36. The reinforcement flange 40 can be formed by rolling over a portion of the railing 38 at bend 48, at an inward angle preferably between zero and ninety degrees. The reinforcement bar can extend along the length of the railing 38.

Preferably, the distance between the bend 50 at the top of the railing 38 and the bend 52 where the support ledge 42 extends away from the railing is less than 50% of the distance between the bend 50 and the bend 48, preferably 25%. That distance defines a lip 53 adjacent to the support ledge.

The gusset 44 is a support structure that can be any relevant shape, comprising enough material to provide strength and stability near the junction with the headboard. The side rail 36 can have the gusset 44 on either or both ends of the rail. The gusset 44 preferably protrudes above the support ledge 42, rather than below the railing 38 as in the prior art. Consequently, a clean horizontal line beneath the side rail 36 can be seen all the way to the headboard to which it is mounted, allowing for additional space underneath the bed frame where items such as furniture can be placed freely against the headboard.

The single piece side rail 36 can be manufactured by cutting the shape required for the railing 38, the reinforcement flange 40, the support ledge 42, the gusset 44, and the fastening tab 46 from a single flat piece of steel. The reinforcement flange 40 and the support ledge 42 can then be bent into the positions shown in FIG. 4 or similar positions using roll forming or another bending method.

Figure 5:
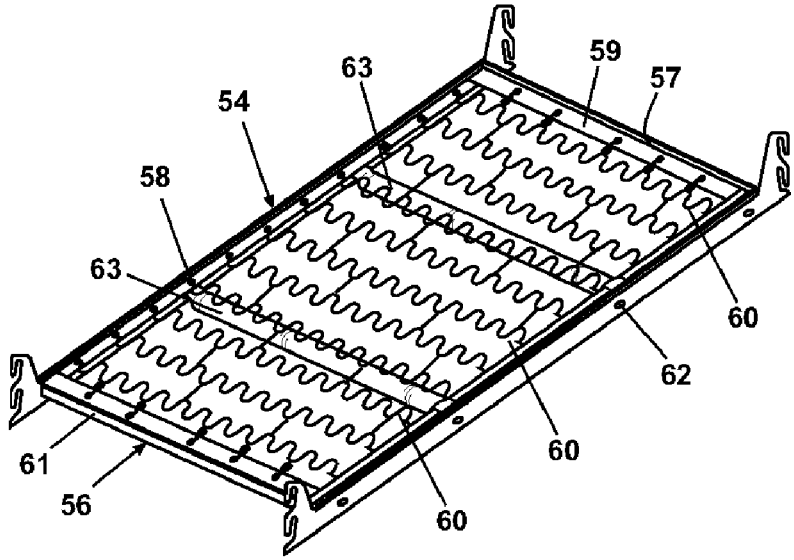
FIG. 5 is a perspective view of a bed frame according to the invention.

FIG. 5 illustrates an embodiment of a bed frame 54 comprising a pair of cross supports 56 attached to each end of two single piece side rails 36 on top of the support ledge 42. The cross supports 56 can be welded to the side rail 36, but can also be attached by using fasteners or by other methods. Preferably, at least one cross support 56 has a lip 57 and support ledge 59 sized roughly equivalent to the lip 53 and support ledge 42 of the side rails 36. Additionally or alternatively, at least one cross support 56 can be angle stock 61. A pair of cross braces 63 serves to keep the side rails 36 roughly parallel. A number of support ledge holes 58 can be created at various spots in the support ledge 42 which can allow a system of springs 60 to be attached through the support ledge holes 58 to the bed frame 54. The system of springs 60 are coils of metal or any other material of any shape that can be drawn between two or more side rails that can support a mattress.

Figure 6:
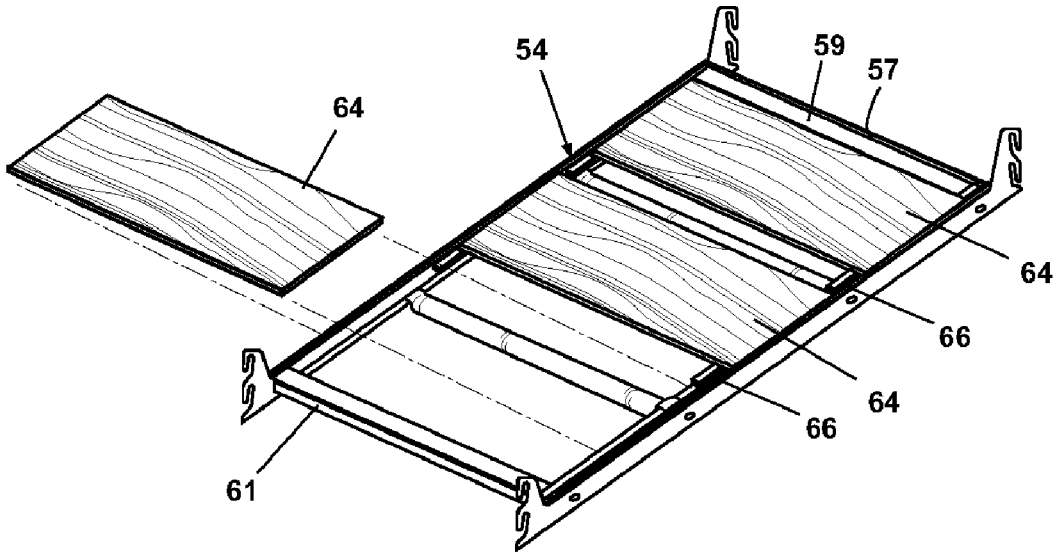
FIG. 6 is a perspective view of an alternative embodiment of a bed frame according to the invention.

FIG. 6 illustrates an alternative to the system of springs 60, wherein a series of boards 64 form a foundation in the bed frame 54. The series of boards 64 define a flat support surface that can consist of a single board or multiple boards made out of wood, metal, plastic, or other materials. An indentation 66 can be fabricated in various locations in the support ledge 42 of each single piece side rail 36 to hold the boards in the series of boards 64 apart from each other. The indentations 64 can be any elevation made by distorting or adding additional material to a section of the support ledge 42. The series of boards 64 can support a mattress. The lips 53, 57 prevent the boards and any mattress thereon from moving laterally, retaining them over the bed frame 54.

While the invention has been specifically described in connection with certain specific embodiments thereof, it is to be understood that this is by way of illustration and not of limitation, and the scope of the appended claims should be construed as broadly as the prior art will permit.

What is claimed is:

1. A unitary headboard comprising two posts with a stacking projection extending from an upper end of each post and at least one cross support extending between the posts, wherein the posts and the at least one cross support are integrally formed from a single piece of material and are capable of supporting a bed frame.

2. The unitary headboard of claim 1 wherein the posts and the at least one cross support are integrally formed from a single piece of plywood.

3. The unitary headboard of claim 1 wherein the stacking projection is integrally formed from the same piece of material as the posts and the cross support.

4. The unitary headboard of claim 1, further comprising a stacking recess in a lower end of each post, wherein the stacking recess is complementary in shape to the stacking projection.

5. The unitary headboard of claim 1 wherein the cross support is a stylized shape.

6. The unitary headboard of claim 1, further comprising at least one bedpost unit mounted to each post.

7. The unitary headboard of claim 1, further comprising a tab insert channel in each post.

8. A bed frame comprising the unitary headboard of claim 1, side rails and cross supports, wherein each side rails is formed of a single piece of material, and comprises an upwardly extending lip and a support ledge extending generally horizontally from the lip.

9. The bed frame of claim 8, further comprising a reinforcement flange in each side rail.

10. The bed frame of claim 8 wherein the support ledge comprises holes adapted to receive springs.

11. The bed frame of claim 8 wherein the lip extends above the support ledge less than 50% of the height of the side rail.

12. The bed frame of claim 8, further comprising a gusset at each end of the side rail, wherein the gusset extends above the support ledge.

13. In abed comprising two headboards spaced from each other and a bed frame mounted to and extending between the headboards, the improvement wherein one of the headboards is a unitary headboard comprising two posts with a stacking projection extending from an upper end of each post and at least one cross support extending between the posts, wherein the posts and the at least one cross support are integrally formed from a single piece of material and are capable of supporting the bed frame.

14. The bed of claim 13 wherein the posts and the at least one cross support of the unitary headboard are integrally formed from a single piece of plywood.

15. The bed of claim 13 wherein the cross support of the unitary headboard is a stylized shape.

16. The bed of claim 13 wherein the bed frame comprises side rails wherein each side rail comprises an upwardly extending lip and a support ledge extending generally horizontally from the lip.

17. The bed of claim 13, further comprising a reinforcement flange in each side rail.

18. The bed of claim 13 wherein the support ledge comprises holes adapted to receive springs.

19. The bed of claim 13 wherein the lip extends above the support ledge less than 50% of the height of the side rail.

20. The bed of claim 13, further comprising a gusset at each end of the side rail, wherein the gusset extends above the support ledge.

* * * * *